United States Patent [19]

Boitani

[11] Patent Number: 4,738,342

[45] Date of Patent: Apr. 19, 1988

[54] SMALL RIGID PORTABLE LADIES' CASE

[76] Inventor: Maria Boitani, Via Bissolati 54, 00187 Roma, Italy

[21] Appl. No.: 3,251

[22] Filed: Jan. 14, 1987

[30] Foreign Application Priority Data

Aug. 6, 1986 [IT] Italy ..... 36006/86[U]

[51] Int. Cl.[4] ..... A45C 03/00

[52] U.S. Cl. ..... 190/111; 150/117

[58] Field of Search ..... 190/102, 108, 112, 109, 190/110, 111, 115, 113, 119, 900; 150/117, 112, 113

[56] References Cited

U.S. PATENT DOCUMENTS 2,533,850 12/1950 Syracuse ..... 150/112 X 3,335,775 8/1967 Adams ..... 150/117 X

FOREIGN PATENT DOCUMENTS 659112 10/1951 United Kingdom ..... 190/109

*Primary Examiner*—William Price

*Attorney, Agent, or Firm*—Wenderoth, Lind & Ponack

[57] ABSTRACT

The present invention is a small rigid portable ladies' case having a top portion, two side portions, a front central portion and a rear central portion. The top portion and the side portions have a convex configuration, while the front and the rear central portions have a flat configuration. The front surface of the top portion and the front surface of the side portions from convering walls respectively of a first, a second and a third corresponding cavity. The bottom wall of the first, second and third cavities is the rear surface of the top portion and of the side portions. Additionally, the cover of the front central portion has a flat shape and can be opened outwards of a fourth rectangular inside cavity. The rear central portion opens in a bellows-like manner towards the outside as the case includes bellows-shaped partitions. The small rigid portable case is particularly suitable for keeping documents, papers, and person belongings which a woman may require during business travel.

3 Claims, 2 Drawing Sheets

FIG. 3
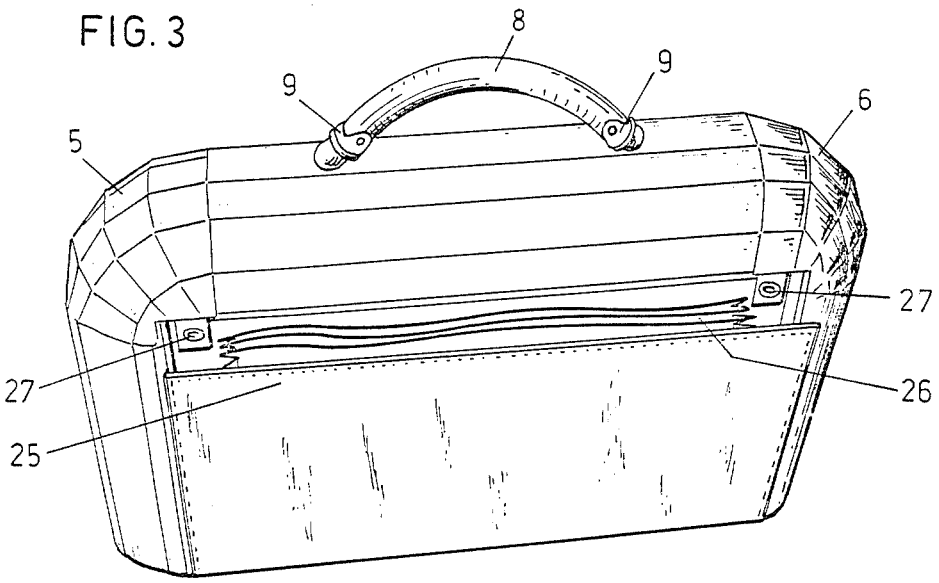
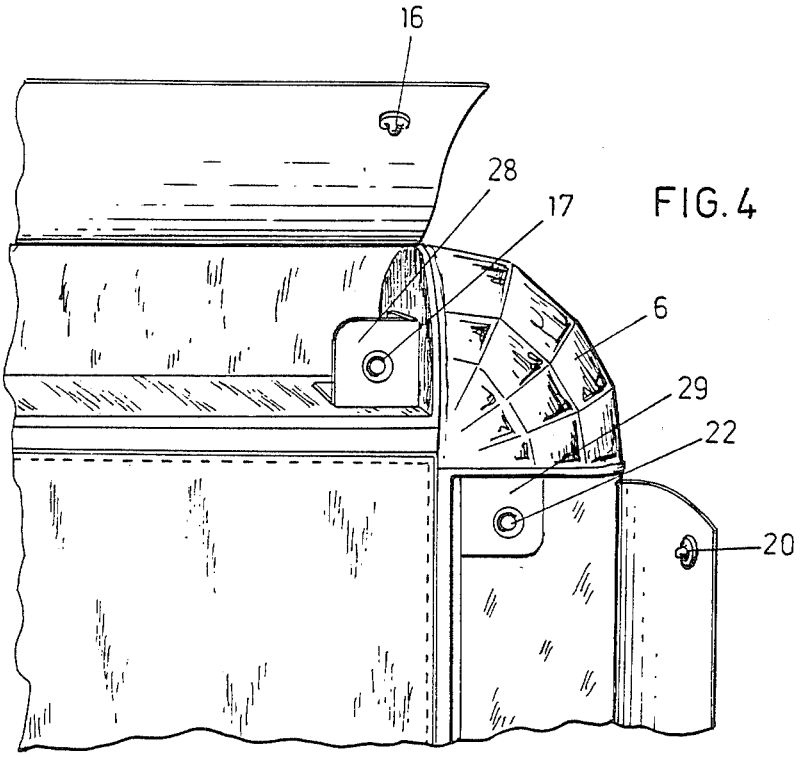
FIG. 4

SMALL RIGID PORTABLE LADIES' CASE

BACKGROUND OF THE INVENTION

The present invention relates to a small rigid portable ladies' case.

More particularly, the present invention relates to a small portable case which is particularly suitable for keeping documents, papers, and the personal belongings that a woman may require during business travel.

As is well known, all women engaged in any kind of professional activity, while preparing for business travel, need to arrange, in a rational way, both their own things relating to their job such as papers, documents and so on, and their personal belongings, the latter being quite often more numerous and bulkier than those of a man.

Cases commercially available at the present time that find such a use in business travel consist of small portable cases of the so-called "twentyfour hours' journey" type, said cases including a number of partitions in which both the things needed for work and any personal belongings, such as for instance night-dresses, spare clothes or the like, are to be placed. The other things having a smaller size which are more often employed are normally placed in a bag, so that the professional woman is burdened with the additional weight of the bag.

In almost all types of travelling cases known at the present time, the inside space is divided by means of internal partitions defining areas designed to contain the personal belongings separated from areas that are intended to contain documents and from a number of small bags or receptacles.

As a consequence, in order to take any type of thing out of such a case, it is necessary to open the case very often at the only opening point provided, be it central or lateral, and to take the things desired out of the inside partitions, so that all the other things contained in the adjacent partitions are made visible.

More particularly, this fact may annoy a woman in that, while she is taking documents or other similar things out of the case or while she is placing them into the same, her personal belongings may be seen and become known.

Moreover, cases employed at the present time for carrying documents and the like do not match the style of dresses worn by the professional woman, and on the contrary they very often contrast sharply with the dress, so that they cause her to feel somewhat uneasy.

Thus, it is very clear that there is a need for providing a small portable case that is free from the drawbacks mentioned above and that can contain business papers as well as a variety of personal belongings, from garments to small-size things, and in which case the inside space is so organized as not to allow the things contained within a partition to be viewed when opening the other partitions.

SUMMARY OF THE INVENTION

In order to satisfy such a requirement, the present invention proposes to provide a small portable case in which the inside partitions are a series of partitions of various sizes and for various uses, each of which can be opened separately from the outside.

Accordingly, it is a specific object of the present invention to provide a small rigid portable ladies' case characterized in that it comprises a top portion, two side portions, a front central portion and a rear central portion, said top portion and said side portions having a convex configuration, said front and rear central portions having a flat configuration, in which case the front surface of said top portion and the front surface of said side portions form covering walls respectively of a first, second and third corresponding cavity. The bottom wall of said first, second and third cavity are made up of the rear surface of said top portion and of said side portions, wherein said first central portion having a flat shape can be opened towards the outside and defines a fourth rectangular inside cavity, and wherein said rear central portion can be opened in a bellows-like manner towards the outside and wherein a number of bellows-shaped partitions are provided between the inside part of said rear central portion and the outside surface of the bottom part of said fourth cavity. The fact that said fourth cavity is closed inside by a rigid rectangular cover on which the locking members are provided is an advantage of the present invention.

Moreover, said closing portions of said top portion and of said side portions are advantageously integral with the respective bottoms walls and can be opened with respect to the same.

According to a preferred embodiment of the present invention, the small rigid portable case has an arc shaped handle on its top portion.

BRIEF DESCRIPTION OF THE DRAWINGS

The present invention will be disclosed in the following description for illustrative but not limitative purposes with reference to the enclosed drawings in which:

FIG. 3 is a top perspective view of the case of the present invention with its rear partition open;

FIG. 4 is a detailed view of the small case according to the present invention.

DETAILED DESCRIPTION OF THE PREFERRED EMBODIMENT

Figure 1:
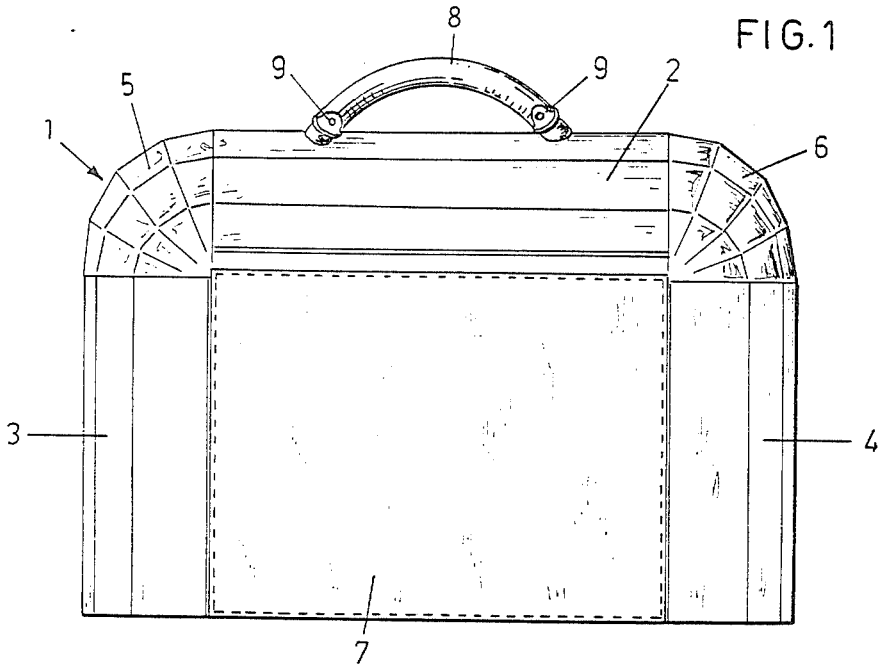
FIG. 1 is a front view of the small case according to the present invention.

As can be seen in FIG. 1, the case 1 includes a top portion 2 and two side portions 3 and 4 both having a convex shape, which are connected respectively with rounded edges 5 and 6.

As is clearly shown in the drawing of FIG. 1, the portions 2, 3, 4 surround a central rectangular front cover 7.

The shape of the edges 5 and 6 as well as that of the portions 2, 3 and 4 is obtained by means of a series of adjacent segments which are disposed at different inclinations with respect to the horizontal plane and, with regard to the edges, with respect to the vertical plane, also.

A handle 8 having a circular cross-section is provided on the top surface of the portion 2, said handle being fastened to the case by means of two tubular members 9.

Figure 2:
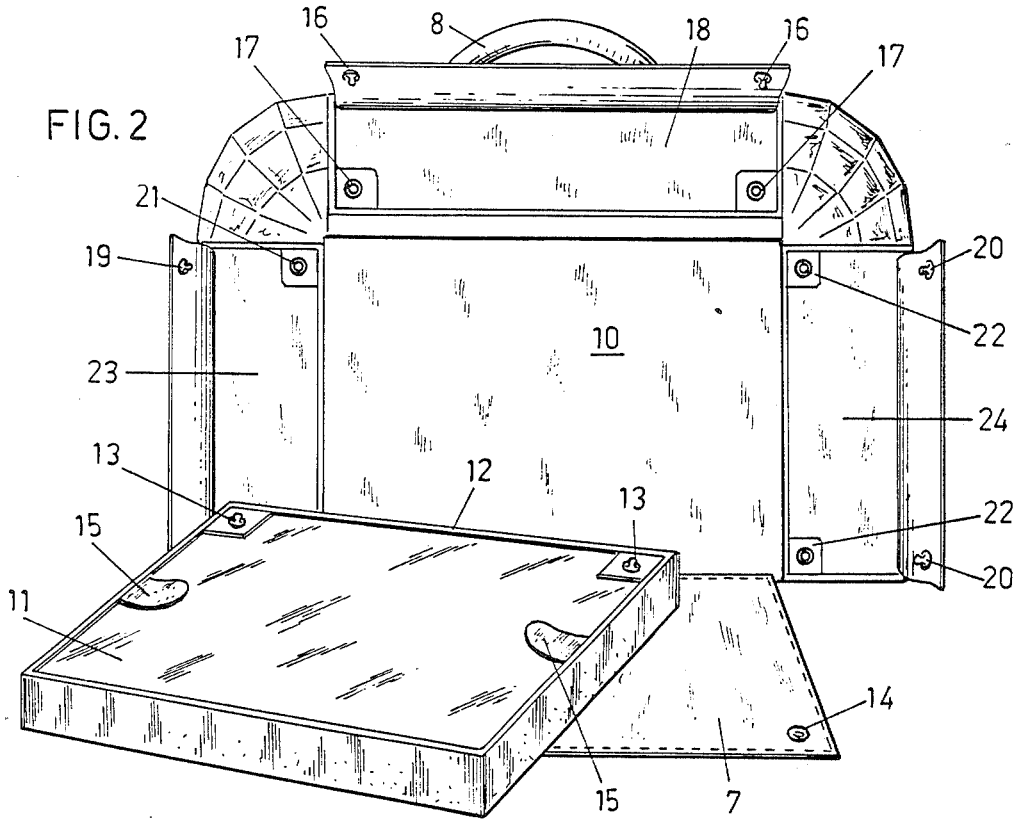
FIG. 2 is a front view of said case with its partitions opened.

FIG. 2 shows the case 1 as seen from the same side as that shown in FIG. 1 with its partitions open. The central rectangular cover 7 pivots through 90° with respect to the lower edge of the case itself and exposes an inside cavity 10 for housing garments, said cavity being in turn occupied by an inside compartment 11 having an upper edge 12 of which the closing members 13 are provided that engage with the corresponding closing members 14 provided near the end of the upper edge of the inside face of the central front cover 7.

In order to make the extraction of the inside compartment 11 from the cavity 10 easier, two tabs 15 are provided on the side edges of said cover.

Both the top portion 2 and the side portions 3 and 4 define a number of inside partitions having an elongated shape which are intended for housing a number of things such as for instance toilet articles, shoes, small things and the like.

As can be observed in FIG. 2, a side surface of the top portion 2 provided with closing members 16 arranged inside the same for the engagement with the corresponding members 17, can pivot along one of the lines which define the succession of the sloping segments, so that it can form the cover of the cavity 18, whose bottom wall is made up of the other side surface of the top portion 2.

Similarly, the side outer surfaces of the lateral portions 3 and 4 can pivot with respect to a vertical segment so as to form the covers provided with inside closing members 19 and 20 for engaging with the corresponding members 21 and 22 of the inside cavities 23 and 24.

The inside surface of the central rectangular member 7, because of its rigid structure, can form a useful supporting base.

FIG. 3 shows a pocket 25 provided in the rear side of the case of the invention, which pocket, because of its size and because of the presence of the inside partitions 26, is intended for housing papers and documents.

The pocket 25 has a bellows-shaped structure and is provided with members inside for engaging with the corresponding members 27 provided on the bottom.

Finally, FIG. 4 shows a detail of the edge 6 which is in the form of a succession of sectors which are inclined so as to collectively have a roundish shape. The same Figure also shows an expedient necessary to align the covers of the top portion 2 and of the side portions 3 and 4 all on the same plane defined by the edges 5 and 6 when said covers are closed.

To that aim, the closing members 17 and 22, which are fastened respectively to a support 28 and 29, must necessarily be positioned slight in back of the closure surface.

The present invention has been disclosed according to a specific embodiment but it is to be understood that modifications and changes can be introduced by those who are skilled in the art without departing from the spirit and scope of the invention for which a priority right is claimed.

The invention claimed is:

1. A small generally rigid portable carrying case comprising:

a central portion having a front portion and a rear portion arranged back-to-back with one another;

said front portion comprising a rectangular cavity, and a flat front cover for exposing and for closing over said rectangular cavity;

said rear portion comprising a plurality of partitions and means for connecting said partitions to one another in a bellows-like manner so as to enable said portions to be spread apart in a bellows-like manner in a direction extending outwards from said rear portion;

two side portions each of which extends along a respective side of said central portion, each of said side portions having a side wall in which is defined a respective side cavity partitioned from said central portion, and comprising a side covering wall for exposing and for closing over the respective side cavity thereof;

said side portions each having a convex shape; and a top portion extending along said central portion in a direction extending between said side portions;

said top portion having a top wall in which is defined a top cavity partitioned from said side cavities and said central portion, and comprising a top covering wall for exposing and for closing over said top cavity;

said top portion having a convex shape.

2. A carrying case as claimed in claim 1, and further comprising a rigid rectangular compartment occupying said rectangular cavity and having closing members for detachably securing the compartment to the case in said rectangular cavity.

3. A carrying case as claimed in claim 1 or 2, wherein the side covering walls of said side portions are integral with the respective side walls, and the top covering wall of said top portion is integral with said top wall.

* * * * *